US006565379B2

(12) United States Patent
Nankou

(10) Patent No.: US 6,565,379 B2
(45) Date of Patent: May 20, 2003

(54) DIVIDED CONNECTOR

(75) Inventor: Yuuichi Nankou, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 10/021,420

(22) Filed: Dec. 19, 2001

(65) Prior Publication Data

US 2002/0081892 A1 Jun. 27, 2002

(30) Foreign Application Priority Data

Dec. 25, 2000 (JP) ..... 2000-393401

(51) Int. Cl.[7] ..... H01R 3/00
(52) U.S. Cl. ..... 439/488; 439/489
(58) Field of Search ..... 439/488, 489, 439/352, 752

(56) References Cited

U.S. PATENT DOCUMENTS 5,338,227 A * 8/1994 Nakamura ..... 439/607
5,660,555 A 8/1997 Ito et al. ..... 439/278

* cited by examiner

*Primary Examiner*—Renee Luebke
*Assistant Examiner*—Ann McCamey
(74) *Attorney, Agent, or Firm*—Banner & Witcoff, Ltd.

(57) ABSTRACT

The invention provides a divided connector wherein, after a sub connector housing has been housed within a frame, the locked state of these two can be checked easily. A divided connector 1 has a sub connector housing 4 provided with terminal housing chambers 16 for housing male terminal fittings 3, and a frame 5 capable of housing the sub connector housing 4. Lock receiving members 14 protrude from left and right side faces 4A of the sub connector housing 4, and resilient locking members 13, these being capable of bending resiliently, are formed at inner wall faces 5A of the frame 5. When the two members 4 and 5 have reached a correct joining position, the resilient locking members 13 return resiliently to their original position, this causing spaces 15 to have a specified size which allows a detecting probe 20 to be inserted therein. If the two members 4 and 5 are halted in a semi-joined position, the resilient locking members 13 remain in a resiliently bent state due to their being pushed by the lock receiving members 14. Consequently, the spaces 15 are in a narrower state which does not allow the insertion of the detecting probe 20.

6 Claims, 9 Drawing Sheets

DIVIDED CONNECTOR

TECHNICAL FIELD

The present invention relates to a divided electrical connector.

BACKGROUND TO THE INVENTION

FIG. 10 of this specification shows a divided connector provided with a sub connector housing 101 capable of housing terminal fittings and a frame 102 capable of housing the sub connector housing 101. Locking members 103 and lock receiving members 104, these being capable of mutually engaging, are formed on the sub connector housing 101 and the frame 102 respectively. The engagement of the members 103 and 104 prevents the two members 101 and 102 from being separated. The locking members 103 formed on the sub connector housing 101 are capable of bending resiliently in a direction perpendicular to the fitting direction of the sub connector housing 101 and the frame 102. The lock receiving members 104 of the frame 102 receive ends of the locking members 103.

In the divided connector described above, the locked state of the locking members 103 and the lock receiving members 104 is checked by either of the following methods:

(1) after the sub connector housing 101 has been housed within the frame 102, the operator pulls these two in a direction of separation; or (2) the operator checks the extent to which the locking members 103 bend away resiliently from the direction in which electric wires extend, these electric wires being joined to the terminal fittings housed within the sub connector housing 101.

In method (1), different operators, or the same operator, may apply differing pulling forces. Consequently, it is difficult to avoid obtaining disparate results. Method (2) is also problematic, since the electric wires interfere with the checking operation. The present invention has taken the above problem into consideration, and aims to present a divided connector wherein, after a sub connector housing has been housed within a frame, the locked state of these two can be checked easily.

SUMMARY OF THE INVENTION

According to the invention there is provided an electrical connector assembly comprising a sub connector adapted to house terminal fittings of wires, and a peripheral frame therefor, the sub connector being insertable in said frame in a fitting direction, and the frame having internal resilient latching members adapted for bending in a direction substantially perpendicular to said fitting direction into corresponding bending spaces, the latching members being for engagement with receiving members of said sub connector to retain the frame and sub connector in a predetermined position, wherein said assembly defines an exit direction for said wires, characterized in that said bending spaces are open to the exterior in a direction other than said exit direction, the bending spaces being adapted to receive a probe for detecting if a latching member is in a respective bending space or not.

Such an arrangement permits the presence of the latching member to be determined according to the depth of probe insertion, and furthermore that the terminal wires do not obstruct probe movement.

Preferably the probe is guided in a channel formed in the receiving members of the sub connector, and furthermore the receiving members preferably include ramp faces to guide a probe to the respective channel.

BRIEF DESCRIPTION OF DRAWINGS

Other features of the invention will be apparent from the following description of a preferred embodiment shown by way of example only in the accompanying drawings in which.

DESCRIPTION OF PREFERRED EMBODIMENT

Figure 1:
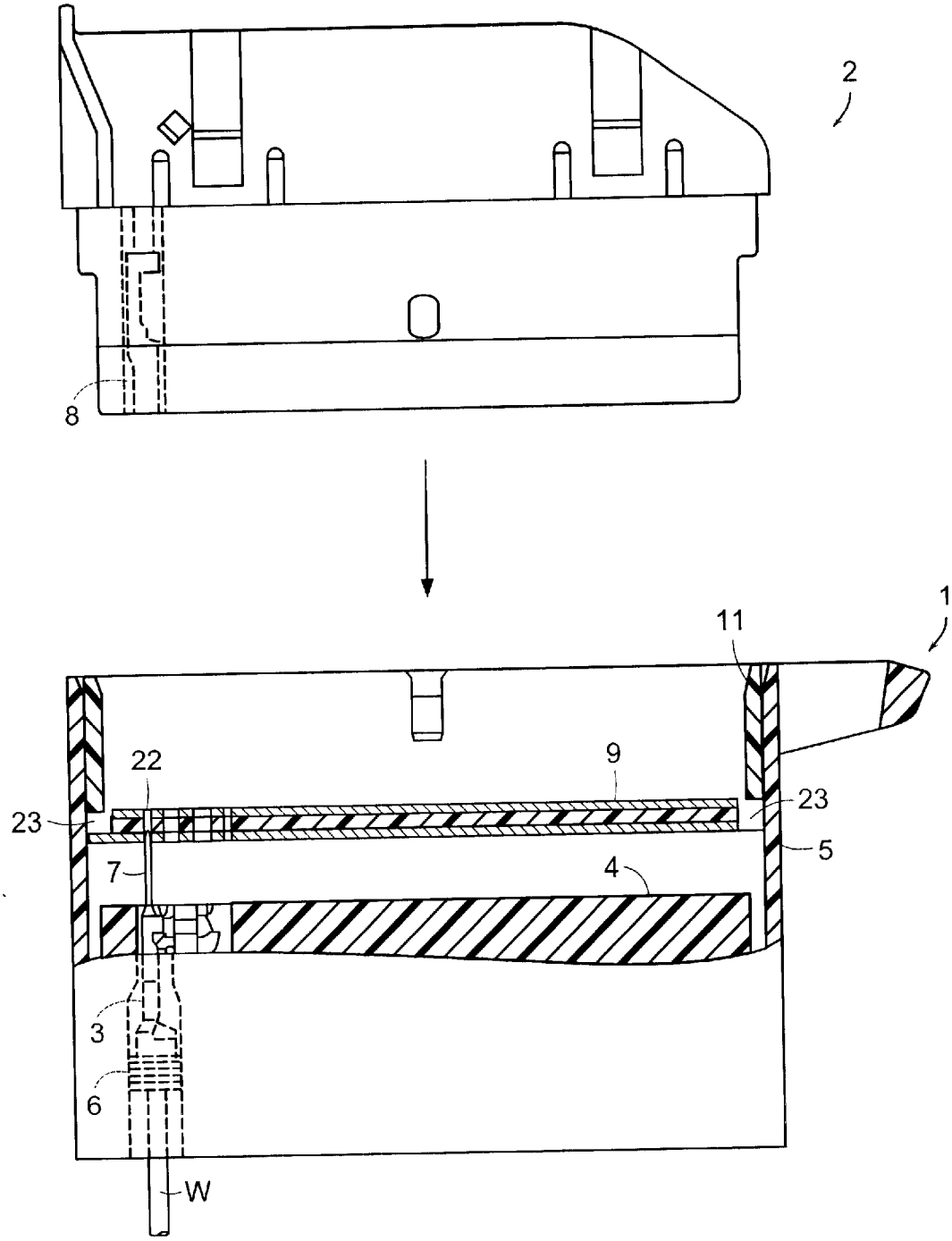
FIG. 1 is a plan view showing a divided connector and a corresponding connector of the present embodiment prior to their being fitted together (a portion of the divided connector is shown cross-sectionally).

FIG. 1 shows a divided connector 1 and a corresponding connector 2 of the present embodiment in a state prior to their being fitted together. The corresponding connector 2 is a female connector which houses female terminal fittings 8. The divided connector 1 is a male connector capable of housing male terminal fittings 3. The two connectors 1 and 2 are capable of fitting mutually together, this fitting together causing the male terminal fittings 3 and the female terminal fittings 8, which are housed within the connectors 1 and 2 respectively, to be joined together. In the following description of the components of the divided connector 1, unless specifically stated otherwise, the anterior side refers to the sides towards the fitting direction of the divided connector 1 and the corresponding connector 2.

The divided connector 1 is broadly divided into: a sub connector housing 4 capable of housing the male terminal fittings 3; a frame 5 capable of housing the sub connector housing 4; and a moving plate 9 provided within the frame 5 at an anterior face side of the sub connector housing 4.

The male terminal fittings 3 are joined with ends of electric wires W, each joining portion thereof being provided with a resilient water-proofing member 6. The electric wires W extend towards the posterior of the divided connector 1 (that is, the direction of extension of the electric wires of the present invention is a posterior direction in the present embodiment). Further, pin-shaped joining protrusions 7, these being capable of joining with the female terminal fittings 8, are formed at anterior ends of the male terminal fittings 3.

Terminal through holes 22 are formed in the moving plate 9 at locations which correspond to the joining protrusions 7 of the male terminal fittings 3. The moving plate 9 is attached from an attaching hole 11 of the frame 5 and is capable of moving in an anterior-posterior direction (i.e., in the fitting direction of the two connectors 1 and 2). When the divided connector 1 is in a single state, whereby it is not yet fitted with the corresponding connector 2, tips of the joining protrusions 7 are located within the terminal through holes 22 of the moving plate 9 (see FIG. 1), this preventing the joining protrusions 7 from moving or being damaged. Furthermore, when the two connectors 1 and 2 are fitted together, the moving plate 9 is pressed by an anterior face of the corresponding connector 2 and moves towards the posterior while the joining protrusions 7 protrude from an anterior face of the moving plate 9, these joining protrusions 7 entering a state whereby they can join with the female terminal fittings 8.

Moreover, probe insertion holes 23, via which a detecting probe 20 can be inserted, are provided in the moving plate 9 at locations to the anterior of resilient locking members 13 of the frame 5.

Figure 2:
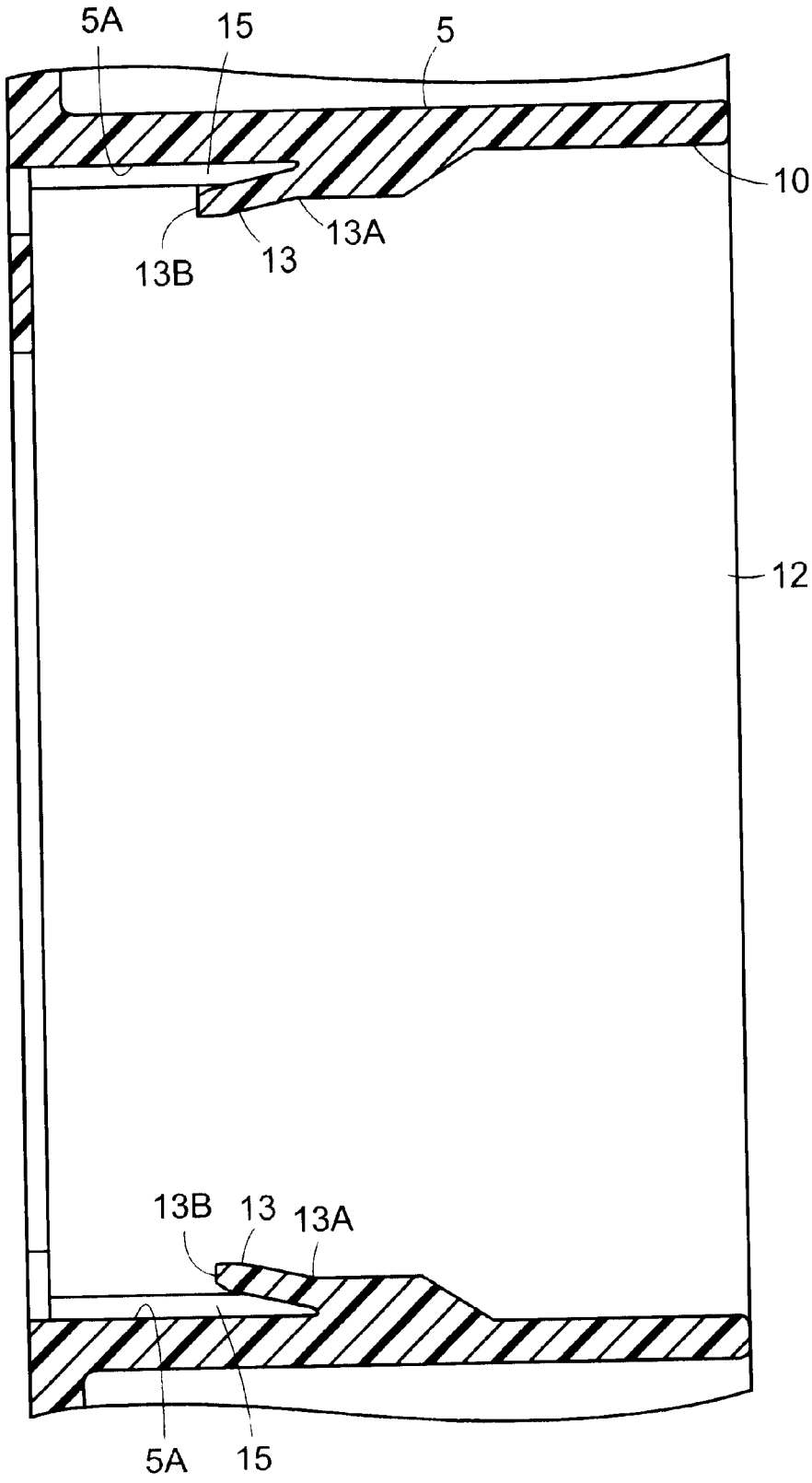
FIG. 2 is a plan cross-sectional view showing a frame from a centre thereof to a posterior end portion thereof.

As shown in FIG. 2, the frame 5 has a tubular shape that is open at the anterior and the posterior. The corresponding connector 2 is inserted therein from the anteriorly-located attaching hole 11. The sub connector housing 4 is fitted therein from a posteriorly-located fitting hole 10. A housing receiving space 12 extends from a posterior end (the fitting hole 10) of the frame 5 to the centre of the frame 5, the sub connector housing 4 being housed therein. The pair of resilient locking members 13 protrude into this housing receiving space 12 from left and right sides thereof (upper and lower sides thereof relative to FIG. 2). Each resilient locking member 13 has a fixed end 13A at its posterior, this being fixed to an inner wall face 5A of the frame 5, and a free end 13B at its anterior, this protruding in an inclined manner towards the centre of the anterior of the housing receiving space 12.

The free ends 13B of the resilient locking members 13 are capable of bending resiliently in the left-right direction of the frame 5 (i.e., perpendicular to the anterior-posterior direction in which the sub connector housing 4 is fitted within the frame 5). Furthermore, spaces 15 (spaces formed between the resilient locking members 13 and the inner wall faces 5A from which these resilient locking members 13 protrude) are open in the direction of the anteriorly-located attaching hole 11. The resilient locking members 13 can bend resiliently into these spaces 15. Moreover, as will be described, the free ends 13B are capable of engaging with lock receiving members 14 of the sub connector housing 4.

Figure 3:
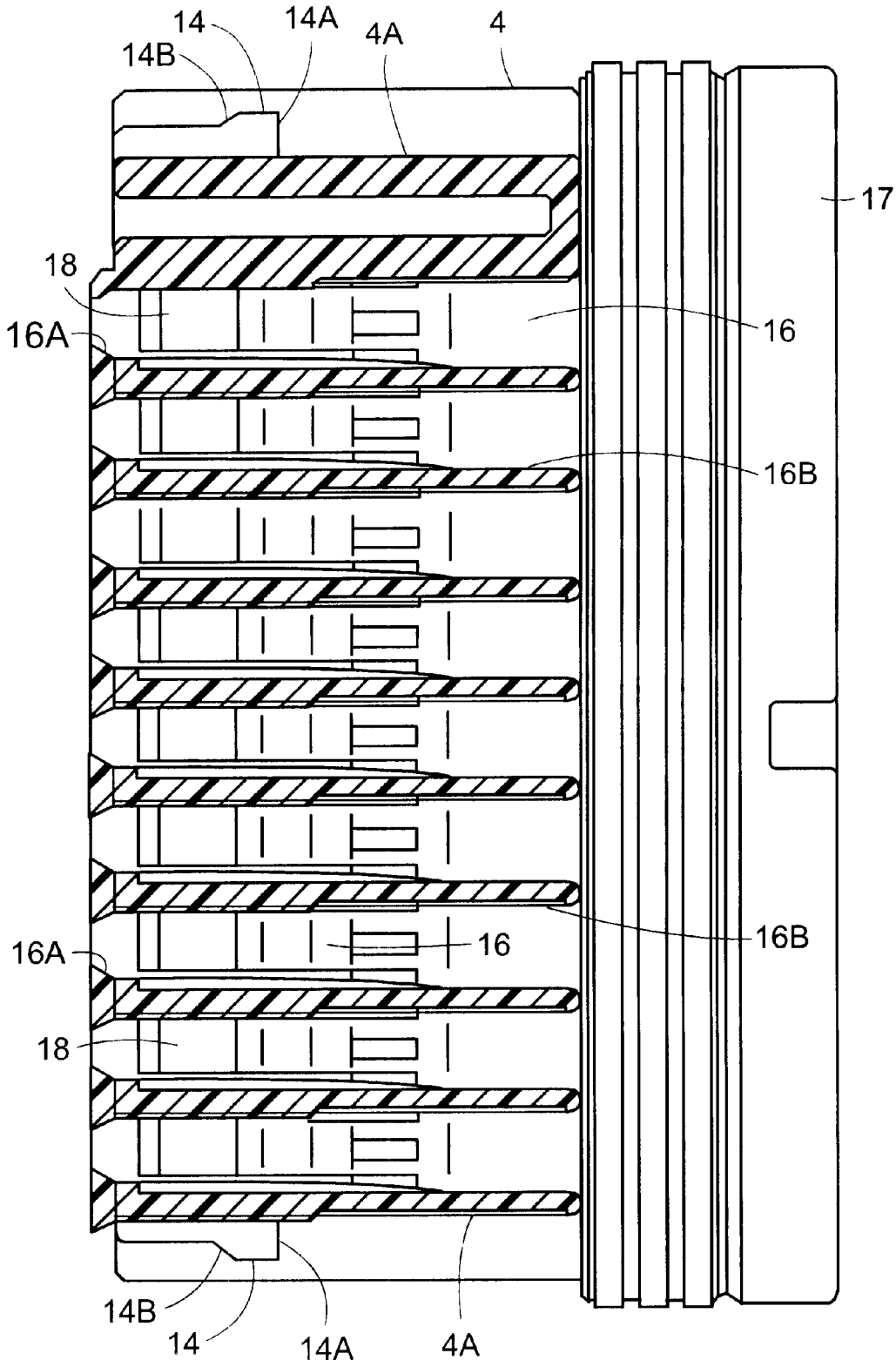
FIG. 3 is a plan cross-sectional view of a sub connector housing.

As shown in FIG. 3, the sub connector housing 4 is formed such that it can be inserted into the housing receiving space 12 of the frame 5. Terminal housing chambers 16 for housing the male terminal fittings 3 are formed within the sub connector housing 4. These terminal housing chambers 16 are open to the anterior and the posterior, the anterior openings being small and forming protrusion insertion holes 16A into which the joining protrusions 7 can protrude. The posterior openings are large and form terminal attachment holes 16B via which the male terminal fittings 3 are attached. Lances 18, which bend resiliently and are capable of engaging with the male terminal fittings 3, are formed at anterior inner portions of the terminal housing chambers 16. Moreover, a resilient ring-shaped water-proofing member 17 is attached to a posterior end portion of the sub connector housing 4. An outer circumference edge of this water-proofing member 17 fits tightly with a hole edge of the fitting hole 10 of the frame 5, thereby achieving a water-proof configuration.

The lock receiving members 14 protrude from left and right side wall faces 4A of the sub connector housing 4. Anterior ends of the lock receiving members 14 form guiding faces 14B which are inclined towards the posterior. When the sub connector housing 4 is fitted within the frame 5, the resilient locking members 13 are pushed outwards, this causing them to bend resiliently. Posterior face ends of the lock receiving members 14 form posterior edges 14A that protrude in an approximately perpendicular manner relative to the side wall faces 4A (more accurately, these posterior edges 14A are inclined slightly towards the posterior, as illustrated). The posterior edges 14A engage with the free ends 13B of the resilient locking members 13 of the frame 5.

Figure 4:
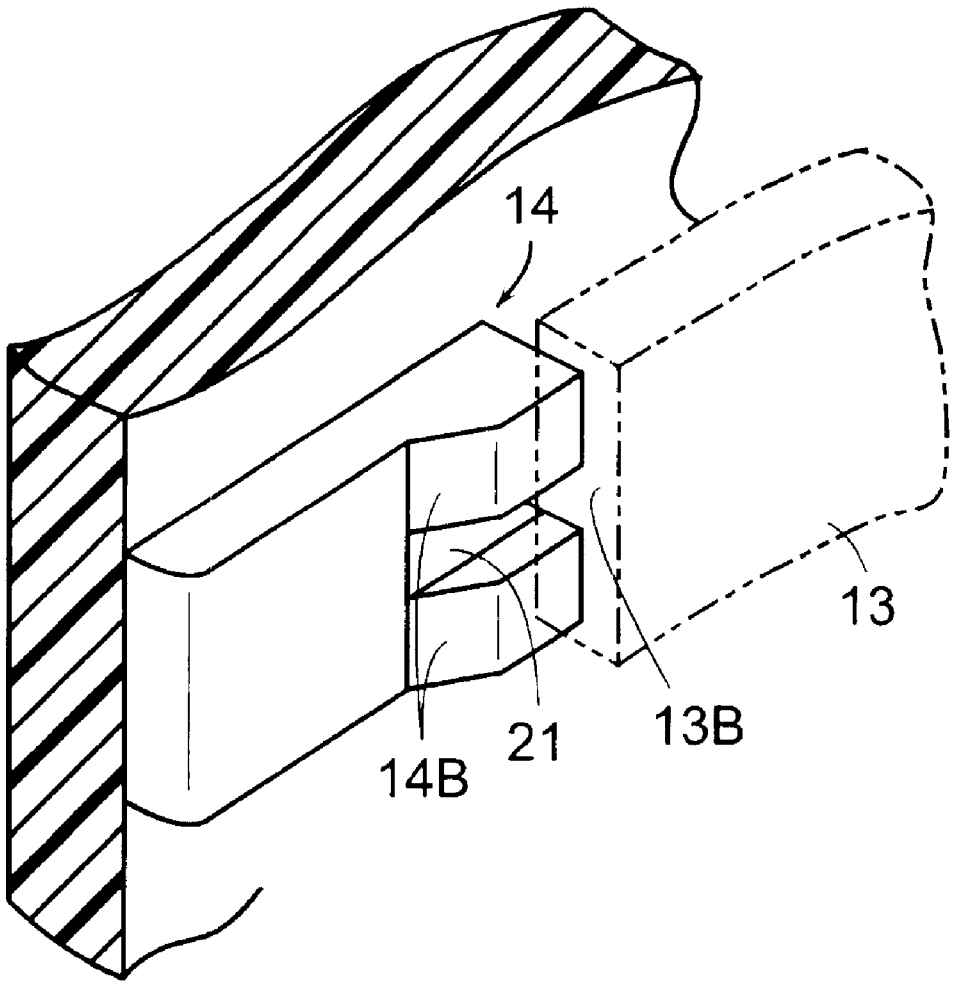
FIG. 4 is an expanded diagonal view of a lock receiving member.
Figure 5:
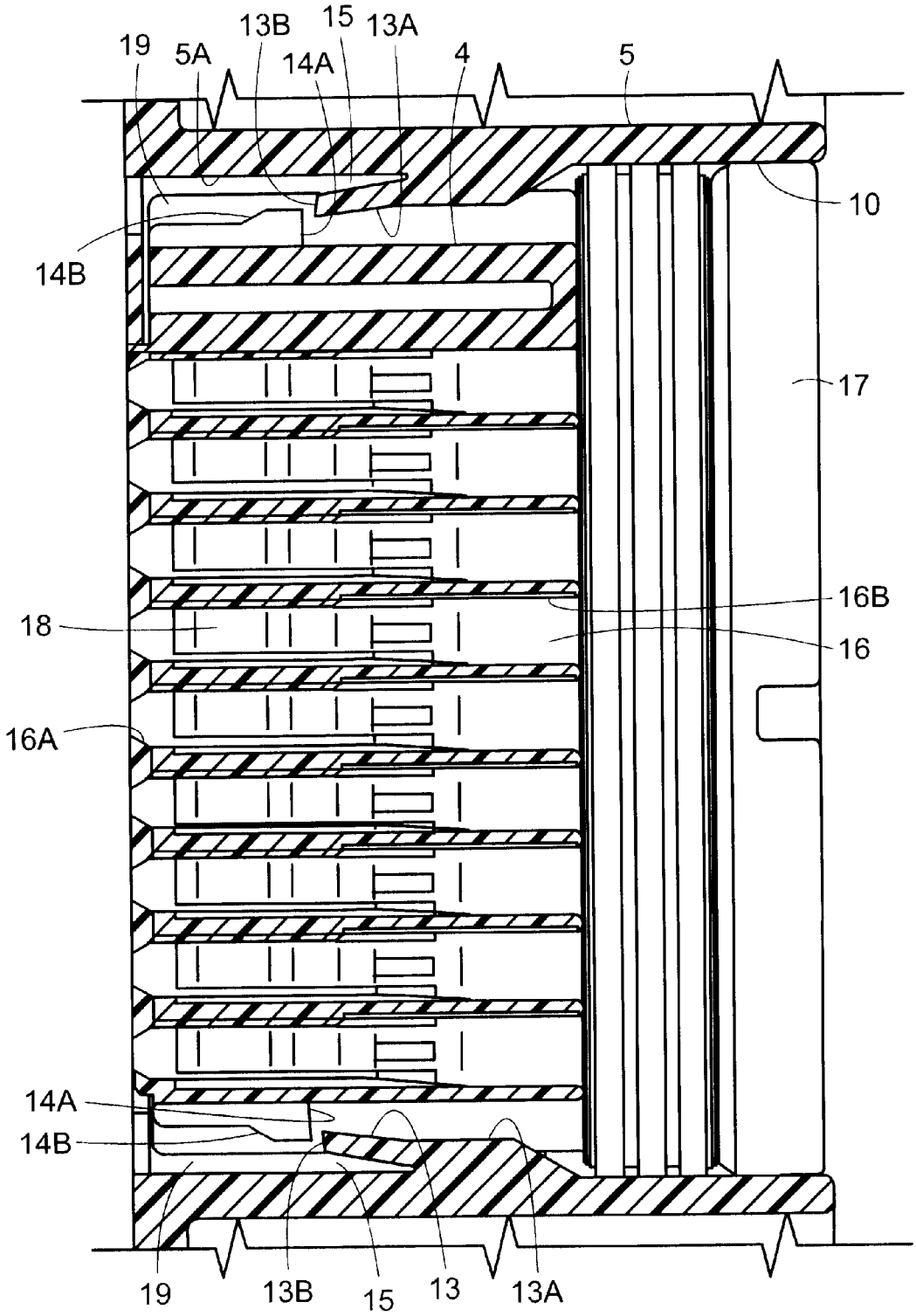
FIG. 5 is a plan cross-sectional view showing the sub connector housing and the frame in a correct joining position.

After the sub connector housing 4 and the frame 5 have been joined in a correct joining position, a space of specified dimensions is formed between the lock receiving members 14 and anterior ends of the resilient locking members 13 (see FIG. 5). These spaces form inserting routes 19 that are open towards the anterior face of the frame 5. The detecting probe 20 (to be described) can be inserted along these inserting routes 19. Furthermore, as shown in FIG. 4, a guiding groove 21, which extends in an anterior-posterior direction, is formed in a centre of each lock receiving member 14. If the detecting probe 20 is inserted in a manner whereby it is misaligned in the direction of the lock receiving members 14, these guiding grooves 21 guide the detecting probe smoothly towards the resilient locking members 13.

The detecting probe 20 is a narrow pole-shaped object which is capable of sliding resiliently, by means of a spring, in an anterior-posterior direction relative to a fixed end hereof (not shown). The detecting probe 20 is inserted from an anterior face of the divided connector 1 and is inserted into the spaces 15 of the resilient locking members 13, the depth to which it can be inserted therein allowing the operator to check whether the resilient locking members 13 and the lock receiving members 14 have engaged.

Next, the operation and effects of the present embodiment configured as described above, are described with the aid of FIGS. 5 to 9.

First, before the frame 5 and the sub connector housing 4 are joined, the male terminal fittings 3, which are joined to the ends of the electric wires W, are housed within the terminal housing chambers 16 of the sub connector housing 4. The male terminal fittings 3 are pushed in to a correct position, then the lances resiliently engage with these male terminal fittings 3, thereby preventing their removal.

Figure 6:
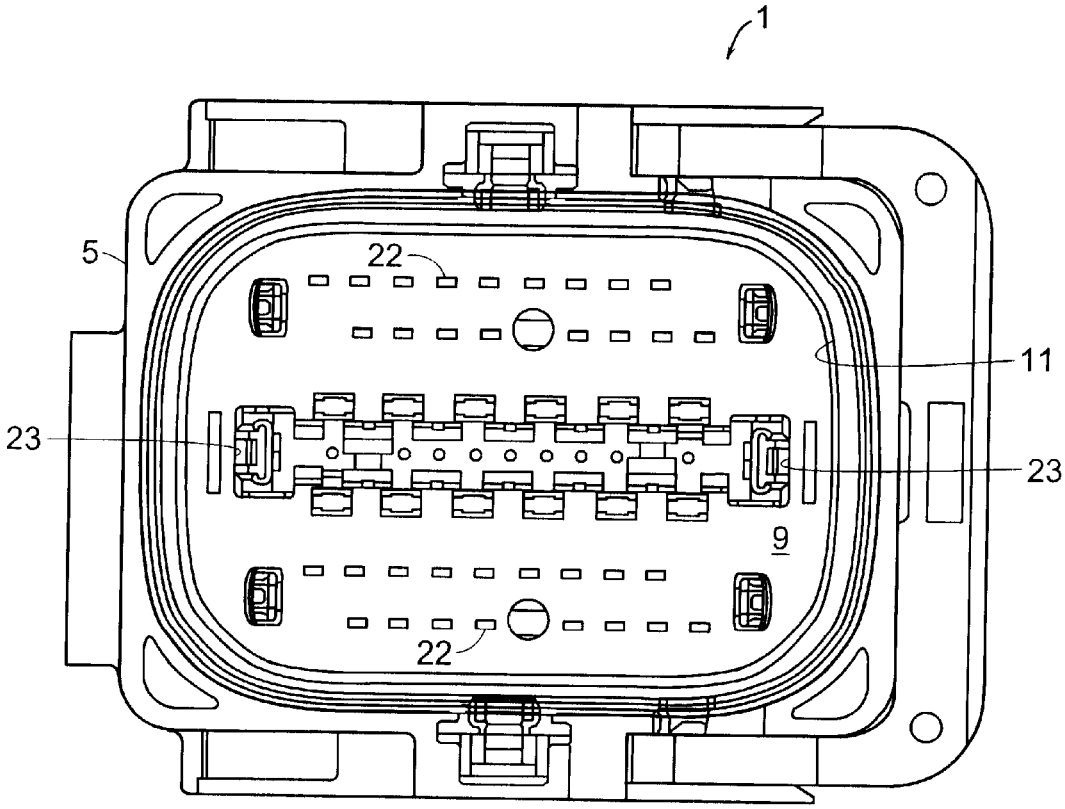
FIG. 6 is a front view of the divided connector.
Figure 7:
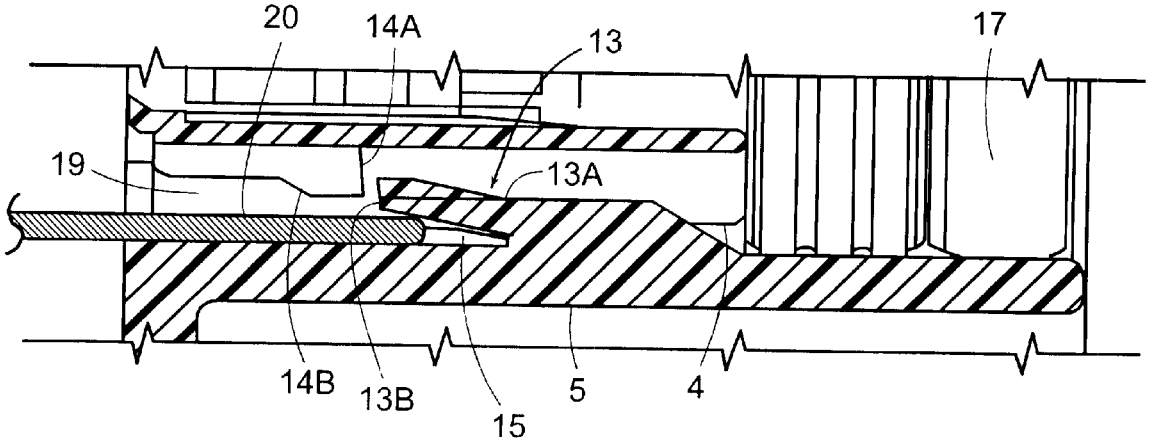
FIG. 7 is a plan cross-sectional view showing the inserting location of a detecting probe when the sub connector housing and the frame are in the correct joining position.

Next, the joining of the frame 5 and the sub connector housing 4 begins, the anterior face end of the sub connector housing 4 being inserted into the fitting hole 10 of the frame 5. As the joining continues, the free ends 13B of the resilient locking members 13 of the frame 5 are pushed outwards by the guiding faces 14B of the lock receiving members 14 which protrude from the sub connector housing 4. This causes the resilient locking members 13 to bend resiliently in the direction of the spaces 15. Then, when the frame 5 and the sub connector housing 4 are fitted together such that they reach a correct joining position, the lock receiving members 14 rise resiliently over the free ends 13B of the resilient locking members 13, and these resilient locking members 13 return to their original position. In this manner, as shown in FIGS. 5 and 6, the resilient locking members 13 and the lock receiving members 14 engage, this maintaining the sub connector housing 4 in an unremovable state within the housing receiving space 12 of the frame 5. At this juncture, the specified inserting routes 19, which are formed between the inner wall faces 5A of the frame 5 and the side wall faces 4A of the sub connector housing 4, are aligned, at the anterior, with the probe insertion holes 23 of the moving plate 9. In this manner, the spaces 15 open onto the anterior face side of the divided connector 1.

After the joining operation of the frame 5 and the sub connector housing 4 has been completed, the operator uses the detecting probe 20 to check that the two have reached the correct joining position. The resilient locking members 13 return to their original position when the frame 5 and the sub connector housing 4 have been correctly joined, this causing the spaces 15 to have a specified size. Consequently, when the detecting probe 20 is inserted, from the anterior face of the divided connector 1, along the probe insertion hole 23 of the moving plate 9 and the adjoining inserting route 19, the tip of this detecting probe 20 enters the space 15 (see FIG. 7). The detecting probe 20 is inserted to a specified depth, this allowing the operator to judge that the sub connector housing 4 and the frame 5 have reached the correct joining position.

Figure 8:
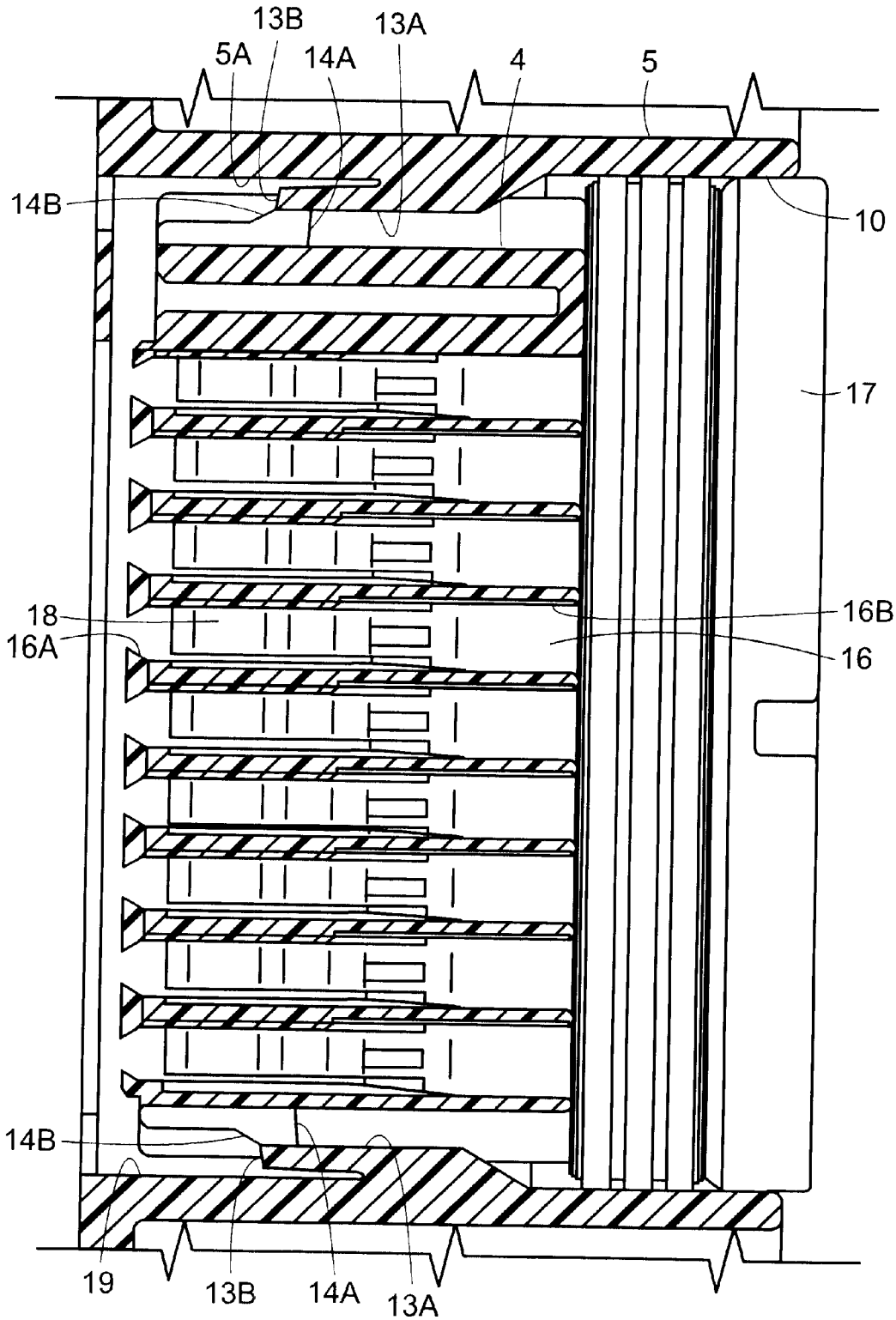
FIG. 8 is a plan cross-sectional view of the sub connector housing and the frame in a semi-joined position, whereby the joining operation has been halted before the two have reached the correct joining position.
Figure 9:
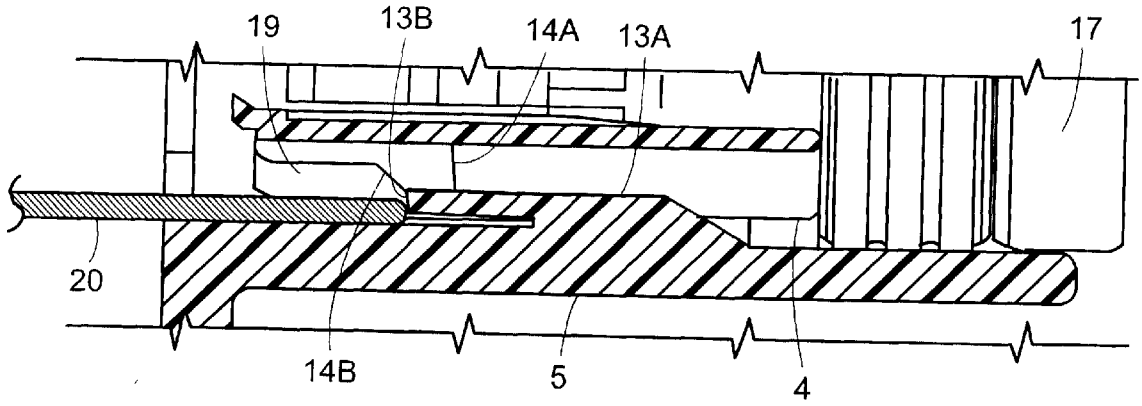
FIG. 9 is a plan cross-sectional view showing the inserting location of the detecting probe when the sub connector housing and the frame are in the semi-joined position.
Figure 10:
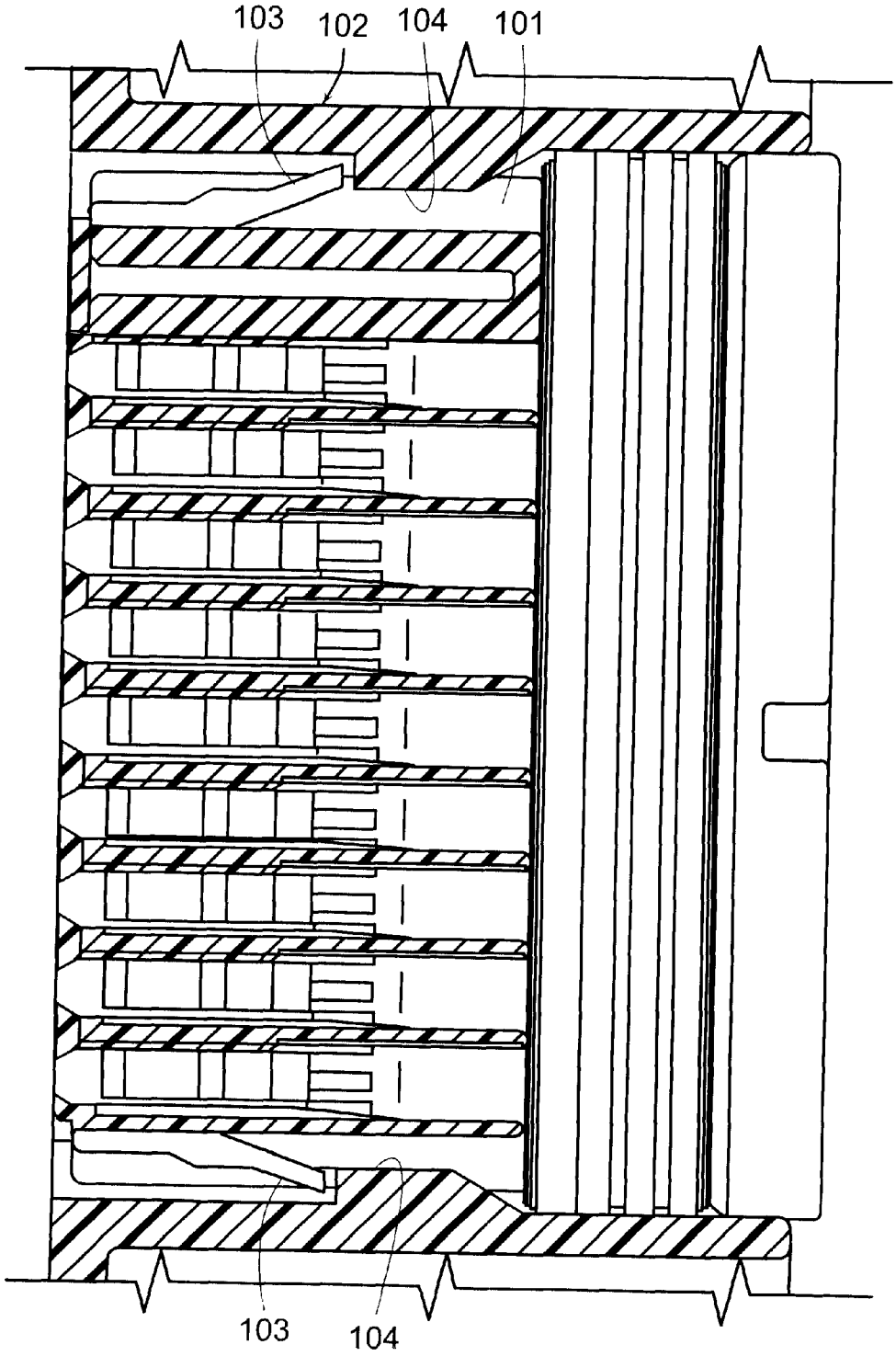
PRIOR ART FIG. 10
FIG. 10 is a plan cross-sectional view of a prior art divided connector.

If the joining of the sub connector housing 4 and the frame 5 should be halted before the two have reached the correct joining position, the resilient locking members 13 are in a state whereby they remain bent by the lock receiving members 14 (see FIG. 8). As a result, the spaces 15 of the resilient locking members 13 are in a narrower state which does not allow the detecting probe 20 to be inserted therein (see FIG. 9). Consequently, the detecting probe 20 is not inserted as far as its specified depth, this allowing the operator to judge that the joining of the sub connector housing 4 and the frame 5 is incomplete.

In the present embodiment, the direction of extension of the electric wires W (towards the posterior) differs from the opening direction of the spaces 15. As a result, when the detecting probe 20 is inserted after the sub connector housing 4 and the frame 5 have been joined, the electric wires W do not interfere with the detecting probe 20, and the locked state can be checked easily.

When the detecting probe 20 is to be inserted, if the tip thereof faces away from the space 15 and instead faces the lock receiving member 14, the guiding groove 21 formed in the lock receiving member 14 guides the tip of the detecting probe 20 towards the space 15. In this manner, the detecting operation can be performed smoothly.

The moving plate 9 of the frame 5 is provided with the probe insertion holes 23 which allow the detecting probe 20 to be inserted therefrom. Consequently, the moving plate 9 does not cause any interference when the joined state of the sub connector housing 4 and the frame 5 is checked, and the detecting operation can be performed smoothly.

The present invention is not limited to the embodiment described above, but may be embodied in various other ways without deviating from the scope thereof. In addition, the technical range of the present invention also encompasses possibilities of equivalent technical range.

What is claimed is:

1. An electrical connector comprising a sub connector adapted to house terminal fittings of wires, and a peripheral frame therefore, the sub connector being insertable in said frame in a fitting direction, and the frame having internal resilient latching members adapted for bending in a direction substantially perpendicular to said fitting direction into corresponding bending spaces by engagement with the sub connector during insertion of the sub connector into the frame, the latching members being for engagement with receiving members of said sub connector to retain the frame and sub connector in a predetermined position, wherein said assembly defines an exit direction for said wires, wherein said bending spaces are open to the exterior in the fitting direction, the bending spaces being adapted to receive a probe for detecting if a latching member is in a respective bending space or not.

2. An assembly according to claim 1 wherein latching members are provided at opposite sides of said frame.

3. An assembly according to claim 1 wherein said latching members comprise cantilevered arms facing substantially in said fitting direction.

4. An assembly according to claim 1 and further including terminals protruding from said sub connector, said frame comprising a hood for said protruding terminals, and the connector further including a guide plate slidable within said hood in the fitting direction to support said protruding terminals, wherein said guide plate is provided with openings adapted to give access of a probe to said bending spaces.

5. An assembly according to claim 1 wherein said receiving members comprise outwardly directed abutments of said sub connector, said abutments each having a through channel to connect a respective bending space to the exterior.

6. An assembly according to claim 5 wherein said abutments each comprise a ramp face on the exterior side of channel, said ramp face being adapted to guide a probe to the respective channel.

* * * * *